US007126814B2

(12) United States Patent
Vathulya

(10) Patent No.: US 7,126,814 B2
(45) **Date of Patent: *Oct. 24, 2006**

(54) SPACE-SAVER DESIGN FOR PERSONAL COMPUTER KEYBOARD

(75) Inventor: Vickram Vathulya, Ossining, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 20 days.

This patent is subject to a terminal disclaimer.

(21) Appl. No.: 10/740,704

(22) Filed: Dec. 19, 2003

(65) Prior Publication Data

US 2004/0130860 A1 Jul. 8, 2004

(51) Int. Cl.
*H05K 5/00* (2006.01)

(52) U.S. Cl. ..... 361/679; 361/683

(58) Field of Classification Search ..... 361/679–681, 361/683–686

See application file for complete search history.

(56) References Cited

U.S. PATENT DOCUMENTS

| | | | | |
|---|---|---|---|---|
| 4,496,943 | A | 1/1985 | Greenblatt | |
| 4,616,798 | A | 10/1986 | Smeenge et al. | |
| 4,619,427 | A | 10/1986 | Leymann | |
| 4,638,969 | A | 1/1987 | Brown | |
| 4,704,604 | A | 11/1987 | Fuhs | |
| 4,776,284 | A | 10/1988 | McIntosh | |
| 4,946,121 | A | 8/1990 | Troke | |
| 5,037,054 | A * | 8/1991 | McConnell | 248/284.1 |
| 5,653,543 | A | 8/1997 | Abe | |
| 5,708,560 | A | 1/1998 | Kumar et al. | |
| 5,987,103 | A * | 11/1999 | Martino | 379/93.17 |
| 6,151,012 | A | 11/2000 | Bullister | |
| 6,208,505 | B1 | 3/2001 | Kuchta et al. | |
| 6,293,508 | B1 | 9/2001 | Kochanski et al. | |
| 6,480,372 | B1 | 11/2002 | Vong et al. | 361/680 |
| 6,510,048 | B1 * | 1/2003 | Rubenson et al. | 361/680 |
| 6,563,700 | B1 * | 5/2003 | Waller et al. | 361/683 |
| 6,657,853 | B1 * | 12/2003 | Oba et al. | 361/681 |
| 6,768,635 | B1 * | 7/2004 | Lai et al. | 361/680 |

FOREIGN PATENT DOCUMENTS

| | | |
|---|---|---|
| EP | 0226869 A1 | 7/1987 |
| EP | 0640489 A2 | 3/1995 |
| FR | 2510782 | 7/1981 |
| WO | WO98/43157 | 10/1998 |

* cited by examiner

*Primary Examiner*—Yean-Hsi Chang

(57) ABSTRACT

A space-saving frame member for use in supporting a keyboard adjacent to a monitor. The frame member has an upper end and a lower end, and means for attaching the upper end of the frame member to the monitor such that the lower end of the frame member extends from a lower side of the monitor to support the keyboard. The frame member may be retractable such that when in an extended position, the user can access the keyboard. When the keyboard is no longer in use, the frame member may be retracted such that the keyboard is stored beneath and behind the monitor.

20 Claims, 7 Drawing Sheets

SPACE-SAVER DESIGN FOR PERSONAL COMPUTER KEYBOARD

FIELD OF THE INVENTION

The present invention relates generally to accessories for computers, and more particularly to apparatus for storing a keyboard.

BACKGROUND OF THE INVENTION

Keyboards are widely used in association with computer terminals and micro-computers. A very popular keyboard is the free-standing type, generally secured by a flexible cord to other hardware. The electrical connection frequently comprises an extensible coiled cord.

A major disadvantage of locating a computer terminal and keyboard in a multi-purpose workspace is the space requirement. In particular, the computer hardware, particularly the keyboard, occupies premium desktop space, even when not in use. This situation, in combination with the generally lightweight nature and unfixed position of such keyboards, sometimes results in their misuse or abuse. For example, a worker wishing to use the desktop space occupied by the keyboard may place the keyboard on its side on the floor, propped against a side of the desk. This creates a generally undesirable situation because of increased risk of damage to a keyboard being temporarily stored on the floor.

One approach to solving this problem has been to provide dedicated workspace, for sole occupation by computer hardware. The additional furniture thus required generally increases the floorspace required for a workspace. This is undesirable in office situations in which office rent is a function of floorspace.

Another solution to the problem of space occupied by idle equipment has been the modification of office furniture in which such computer hardware is to be used. For example, ancillary sideboards or desk run-offs which can accommodate keyboards are commercially available. Certain such sideboards are dedicated to keyboard use, and may be movable, so that it and the keyboard can be moved out of the way of the worker when the keyboard is not needed for use. One such type is akin to the old fashioned retractable typewriter desk, having the sideboard attached with a levered mechanism to a desk whereby the sideboard and keyboard can be swung into a stowed position beneath the desktop. This type of approach suffers from several disadvantages: it being generally expensive to buy and install such sideboards, a large percentage of office furniture is not amenable to retrofitting, requiring replacement with more suitable or adaptable furniture.

Other approaches to solve the space problem created by keyboards are also available. These approaches include a retractable tray for supporting the keyboard. The tray is typically attached to a lower surface of the desktop. For example, U.S. Pat. No. 4,776,284 discloses a retractable work station suitable for use with a computer keyboard. Although this type of system may save space on the desktop, it is not without disadvantages. A major disadvantage is that the keyboard tray is fixed in one position along the workstation. Therefore, if a user desires to relocate the computer and/or monitor associated with the keyboard to another location along the workstation (or to another workstation), the user must disassemble the keyboard tray and reinstall it at the new location.

Thus, a need exists for apparatus for storing a keyboard that keeps the keyboard off and away from the workspace while giving a user flexibility to continue using the keyboard and the ability to easily relocate the keyboard.

SUMMARY OF THE INVENTION

The present invention provides apparatus for supporting a keyboard adjacent to a monitor. An advantage of the present invention is that it keeps the keyboard off and away from the workspace during periods of use and non-use (e.g., storage), while giving a user the ability to easily relocate the monitor and keyboard.

In accordance with one aspect of the invention, an apparatus for supporting a keyboard adjacent to a monitor is provided. The apparatus includes a frame member having an upper end and a lower end, and means for attaching the upper end of the frame member to the monitor such that the lower end of the frame member extends from a lower portion of the monitor to support the keyboard.

In an illustrative embodiment, the frame member is substantially C-shaped and is configured to extend from a rear surface of the monitor, at a point at which the upper end is attached to the monitor, toward the lower portion of the monitor and continuing to extend from the lower portion of the monitor outward and away from a front surface of the monitor.

The frame member is preferably configured to move from an extended position to a retracted position. The frame member may include a tray attached to the lower end of the frame member for supporting the keyboard and may be rotatably attached to the monitor to facilitate changing the angle of the keyboard for the user to make the keyboard ergonomically pleasing to him or herself.

In accordance with another aspect of the invention, a monitor configured to store a keyboard is provided. The monitor includes a display screen housing, and a support frame attached to a rear portion of the display screen housing for supporting the display screen housing at a distance above a desktop. In an illustrative embodiment, the display screen housing and the support frame define a channel therebetween for storing a keyboard. Additionally provided are means for supporting the keyboard at least partially within the channel formed by the display screen housing and the support frame.

These and other features and advantages of the present invention will become more apparent from the accompanying drawings and the following detailed description.

DETAILED DESCRIPTION OF THE INVENTION

The present invention provides a new space-saver design for supporting and storing a keyboard which is typically used with a personal computer or other system having a monitor. Advantageously, the invention maintains the keyboard off of and away from the work surface.

Figure 1:
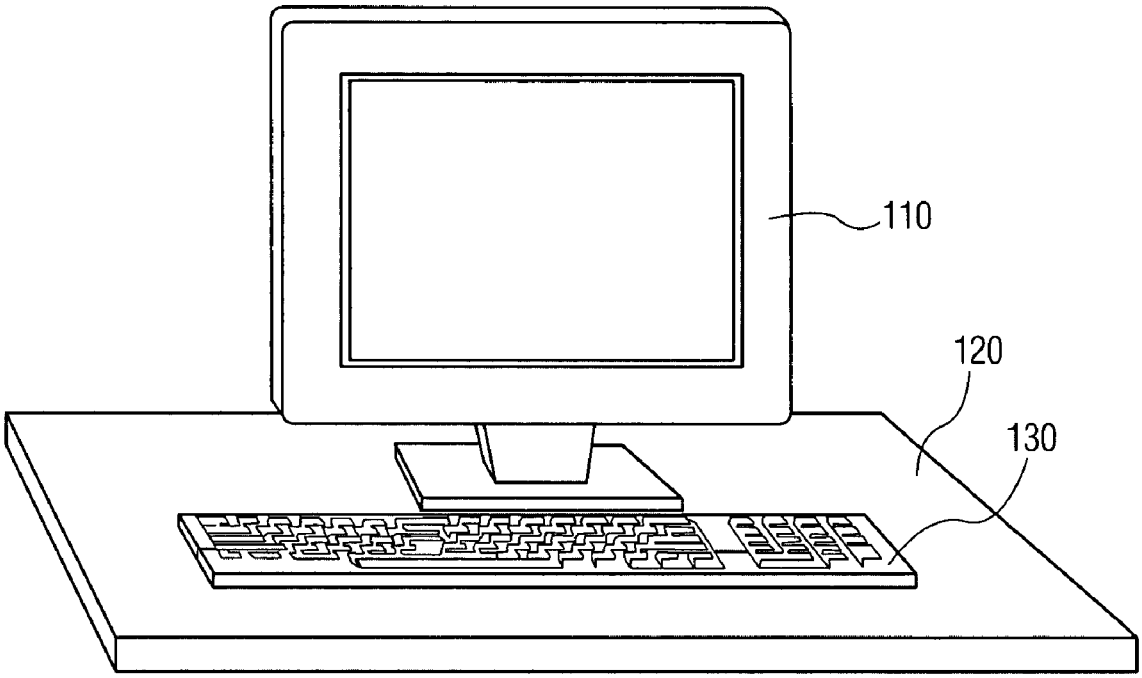
FIG. 1 is a perspective view illustrating a monitor and keyboard with the keyboard resting on an upper surface of a desktop.

Referring now in specific detail to the drawings in which like reference numerals identify similar or identical elements throughout the several views, and initially to FIG. 1, FIG. 1 illustrates a desktop 120 having a monitor 110 and a keyboard 130 positioned thereon. The arrangement illustrated in FIG. 1, as well as all arrangements illustrated herein, is only shown having a monitor 110 and a keyboard 130. However, it is contemplated that the monitor and keyboard may be operatively connected to a central processing unit or the like.

As discussed above, keyboards typically occupy valuable desktop surface space. While in the position illustrated in FIG. 1, keyboard 130 is occupying valuable space on the surface of desktop 120. To utilize the desktop, keyboard 130 may be moved off of the desktop 120. This requirement is inconvenient to the user and makes the keyboard susceptible to damage (e.g., when the keyboard is placed on the floor).

Figure 2A:
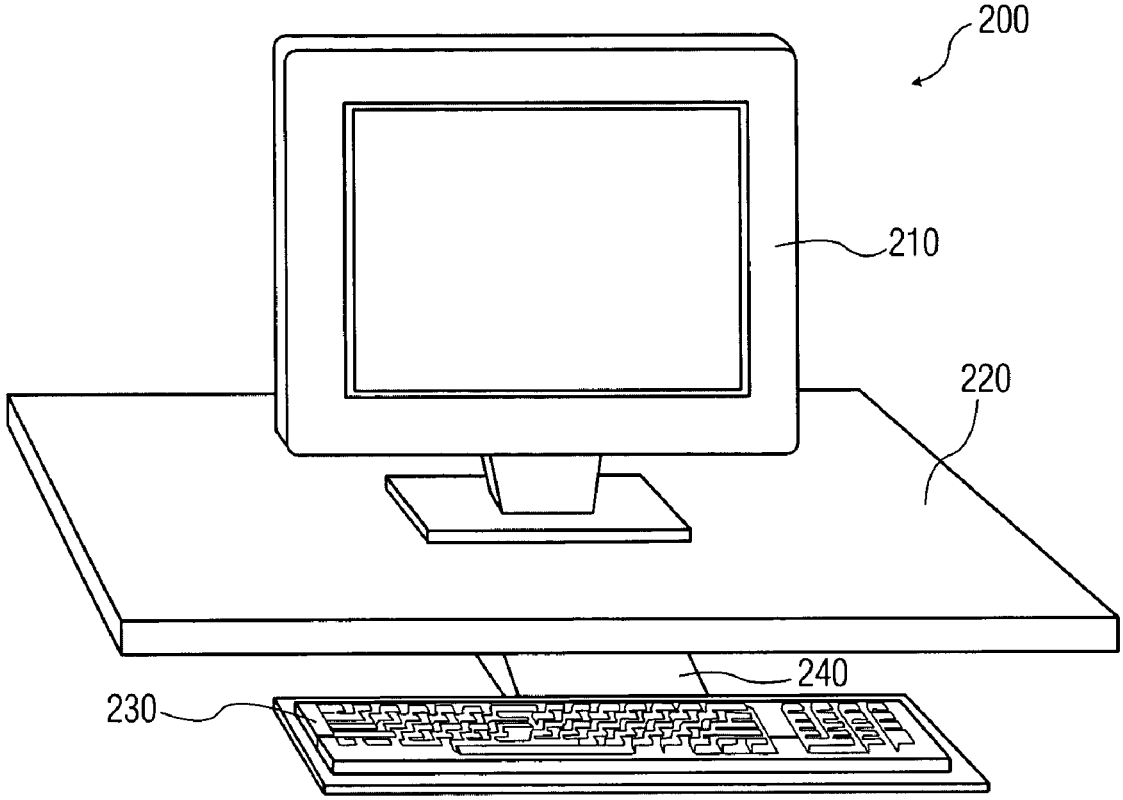
FIG. 2A is a perspective view illustrating a monitor and keyboard with the keyboard mounted on a tray attached to a lower surface of a desktop.
Figure 2B:
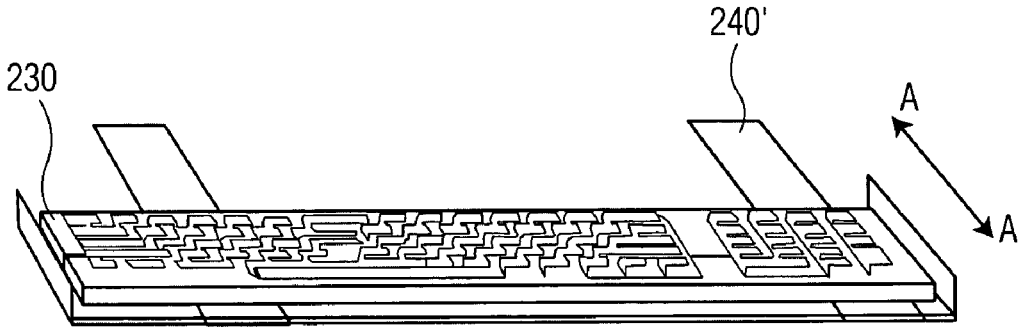
FIG. 2B is a perspective view illustrating a keyboard with the keyboard mounted on a retractable tray which is attached to a lower surface of a desktop.

In FIG. 2A, a typical keyboard and monitor assembly 200 is illustrated. More specifically, the monitor 210 is positioned on an upper surface of a desktop 220. The keyboard 230 is mounted on a frame 240 which is attached to a lower surface of desktop 220. The frame 240 may be stationary or may be designed to allow keyboard 230 to slide back and forth in the direction of arrows AA, as would be possible with the frame 240' shown in FIG. 2B. Thus, in the latter case, when not in use, keyboard 230 may be positioned underneath desktop 220. This configuration makes space available on the desktop. However, the configuration precludes a user from being able to use keyboard 230 on frame 240 if the user moves monitor 210 to a different location on the desktop 220, unless the user physically detaches the frame 240 from the desktop 220 and moves the frame adjacent to the new monitor location.

Figure 3A:
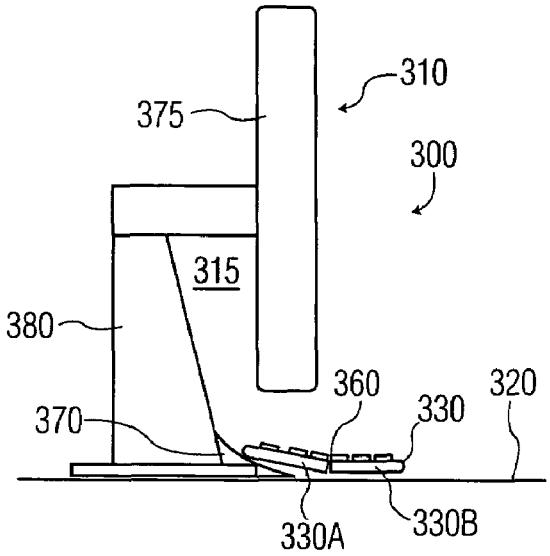
FIG. 3A is a side view illustrating a keyboard adjacent to a monitor in a first position in accordance with an embodiment of the present invention.
Figure 3B:
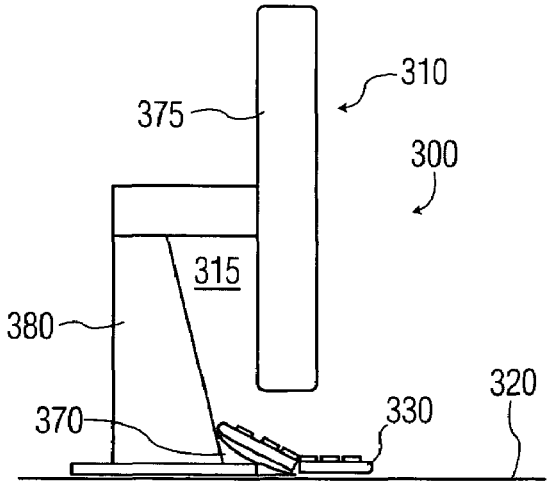
FIG. 3B is a side view illustrating the keyboard of FIG. 3A adjacent to a monitor in a second position.

Referring now to FIGS. 3A through 3D, side views of a monitor and keyboard assembly 300 in accordance with an embodiment of the present invention are illustrated. Referring initially to FIG. 3A, assembly 300 includes a monitor 310 and a keyboard 330 which may be positioned adjacent to the monitor, as described below. Monitor 310 includes a display screen housing 375 and a monitor support member 380. The figures display a progression, of the keyboard 330, from an upper surface of the desktop 320 (see FIG. 3A) to a position located behind display screen housing 375 (see FIG. 3D). Thus, in accordance with an embodiment of the present invention, keyboard 330 is moved off of the desktop surface and safely stored behind display screen housing 375.

Figure 3C:
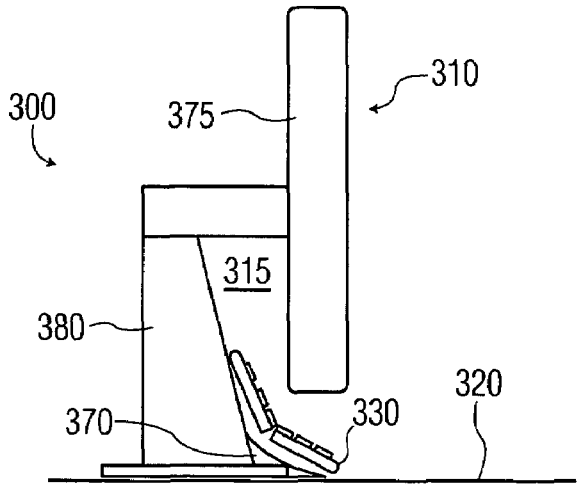
FIG. 3C is a side view illustrating the keyboard of FIG. 3A adjacent to a monitor in a third position.

The keyboard 330 shown in FIGS. 3A through 3D is preferably a folding type of keyboard. Examples of folding keyboards are disclosed, e.g., in U.S. Pat. Nos. 5,653,543 and 6,151,012, the disclosures of which are incorporated herein by reference. Keyboard 330 is divided into two rectangular sections 330A and 330B, along a longitudinal axis thereof. The two sections of the keyboard 330 pivot about a hinge point 360. As illustrated in FIG. 3C, since keyboard 330 has the ability to fold in half longitudinally, keyboard section 330A folds around the lower portion and up the back of display screen housing 375. That is, since keyboard 330 has the ability to pivot about point 360, the keyboard will take the shape of the display screen housing 375, to the extent possible. Thus, keyboard 330 may be stored compactly under and behind display screen housing 375 for retrieval by a user when required.

A ramp 370 is formed at a lower end of monitor support member 380. Ramp 370 assists keyboard 330 in the transition from the desktop to a substantially vertical position within a channel 315 formed between display screen housing 375 and support member 380. Ramp 370 may be a separate unit or it may be integral with monitor support member 380.

Figure 3D:
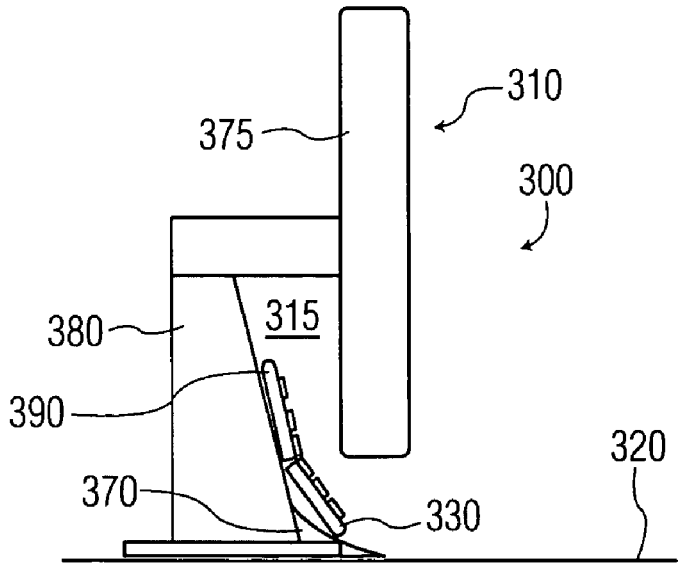
FIG. 3D is a side view illustrating the keyboard of FIG. 3A adjacent to a monitor in a fourth position.

Keyboard 330 may be removably held in a substantially vertical position adjacent to monitor support member 380 by any means known to one having ordinary skill in the art. For example, keyboard 330 may be configured with a strip of Velcro 390 (as shown in FIG. 3D) on a lower surface thereof which will removably attach to a strip of Velcro on monitor support member 380. Alternatively, a flap may be provided on ramp 370 such that the flap will selectively pivot outwardly into a position to restrict keyboard 330 from sliding down onto the desktop 320.

Although it is preferred that monitor 310 is a flat screen monitor, since it will allow more space to store the keyboard than a conventional monitor, the present invention is not limited to a flat screen monitor.

Figure 4:
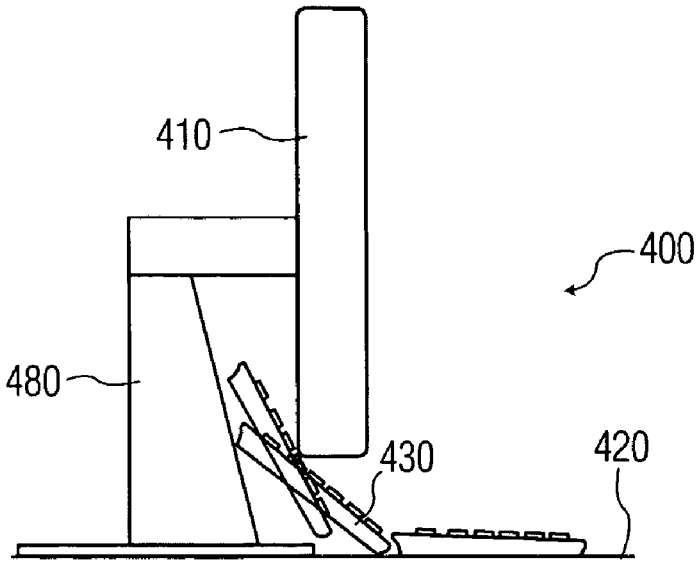
FIG. 4 is a side view illustrating a keyboard and monitor assembly in accordance with an embodiment of the present invention.

Referring now to FIG. 4, a side view of a monitor and keyboard assembly 400 in accordance with an embodiment of the present invention is illustrated. Assembly 400 includes a monitor 410 and a keyboard 430 positioned adjacent to the monitor. The figure displays a progression, of the keyboard 430, from an upper surface of the desktop 420 to a position located behind monitor 410. Thus, in accordance with an embodiment of the present invention, keyboard 430 is moved off of the desktop surface and safely stored behind monitor 410. A difference between keyboard 430 and keyboard 330 is the fact that keyboard 430 is a one-piece keyboard and does not contain a longitudinal separation as does keyboard 330. A one-piece keyboard may require more of a separation between the monitor and support frame so that the keyboard can make the turn to the vertical position.

Figure 5A:
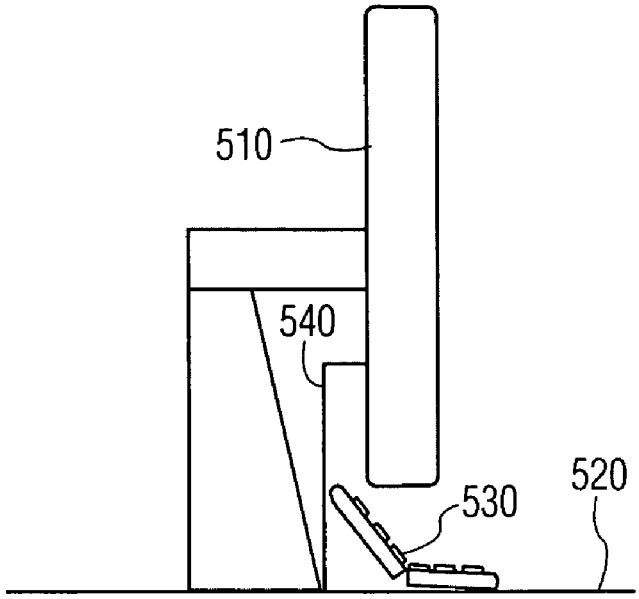
FIG. 5A is a side view illustrating a keyboard at least partially supported on a frame attached to a monitor in accordance with an embodiment of the present invention.
Figure 5B:
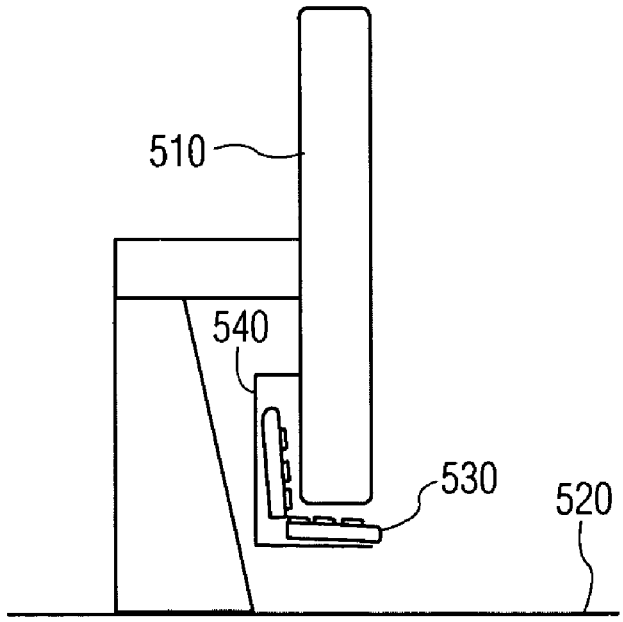
FIG. 5B is a side view illustrating a keyboard supported on a frame attached to a monitor in accordance with an embodiment of the present invention.

Referring now to FIGS. 5A and 5B, a keyboard and frame attached to a monitor are illustrated in accordance with another embodiment of the present invention. Monitor 510 is positioned on an upper surface of a desktop 520. Keyboard 530 is held adjacent to monitor 510 via a keyboard support frame 540 in accordance with an embodiment of the present invention. That is, keyboard support frame 540 is preferably configured to support keyboard 530 and allow keyboard 530 to be maintained in a fixed position adjacent to monitor 510 at a point above the surface of the desktop 520.

As illustrated in FIG. 5B, keyboard support frame 540 is configured to retract upwardly toward monitor 510 to lift keyboard 530 off of the surface of desktop 520, thereby making valuable desktop surface area available. Keyboard 530 may be biased in the retracted position illustrated in FIG. 5B by any means known to one having ordinary skill in the art, such as, e.g., via a spring housed within support frame 540 or a pneumatic piston. Keyboard support frame 540 may be configured in a plurality of arrangements such as, for example, a tray or a set of rails or elongate tubular members. For example, support frame 540 may be a solid tray having a width as wide as monitor 510 or it may be a series of two or more elongate tubular members.

Figure 6A:
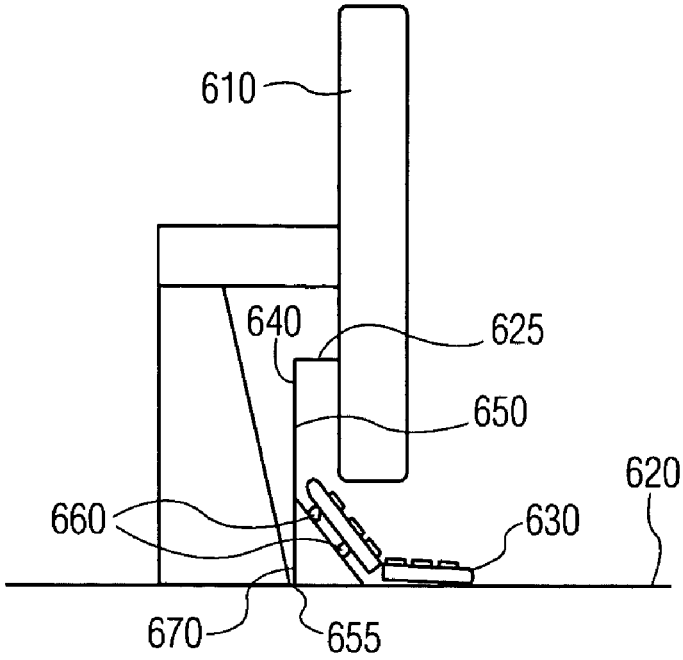
FIG. 6A is a side view illustrating a keyboard at least partially supported on a frame attached to a monitor in accordance with another embodiment of the present invention.
Figure 6B:
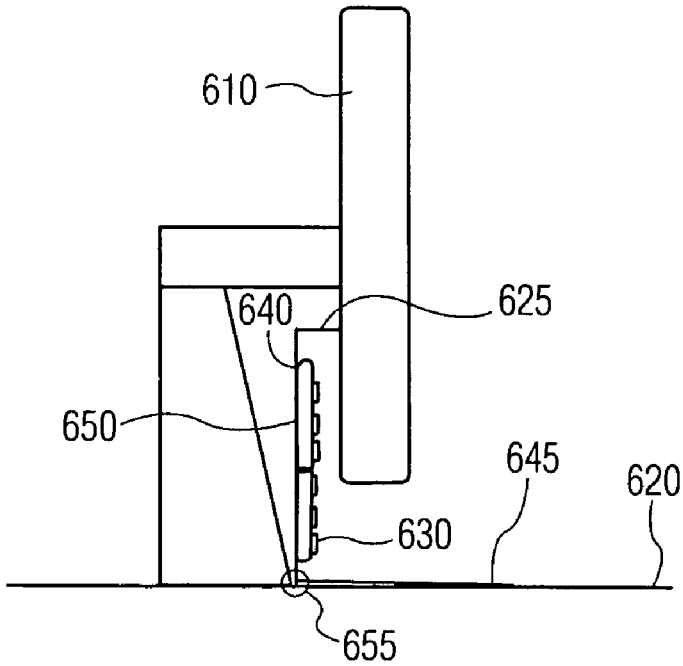
FIG. 6B is a side view illustrating a keyboard supported on a frame attached to a monitor in accordance with another embodiment of the present invention.

FIGS. 6A and 6B are side views illustrating a monitor 610 and a keyboard 630 in accordance with yet other embodiments of the present invention. Keyboard 630 is held adjacent to monitor 610 via a keyboard support frame 640 in accordance with an embodiment of the present invention. That is, keyboard support frame 640 is preferably configured to support keyboard 630 and allow keyboard 630 to extend outward from monitor 610 when in use. More specifically, a lower portion 645 (FIG. 6B) of support frame 640 is configured having a length which allows the user to rest keyboard 630 thereon while in use. It is also contemplated that lower portion 645 may be a retractable tray.

Keyboard support frame 640 may be configured in a plurality of arrangements such as, for example, a tray or a set of rails or elongate tubular members. In an embodiment of the present invention, the support frame 640 is configured to extend from a rear surface of the monitor. An upper end 625 of the support frame 640 is attached to the monitor by any means known to one having ordinary skill in the art, such as, e.g., by bolting the support frame to the back of monitor 610. Support frame then extends from the lower portion of the monitor outward and away from a front surface of the monitor. As illustrated in FIGS. 6A and 6B, support frame 640 is substantially C-shaped in cross-section.

Furthermore, keyboard support frame 640 may be retractable or stationary. In the embodiment where frame 640 is stationary, keyboard 630 may move, independent of frame 640, from an extended to a retracted position by sliding on frame 640. Alternatively keyboard 630 may be configured with rollers 660 on a bottom surface thereof, to facilitate movement from an extended position to a retracted position. The retractable embodiment of the support frame may be in the form of a telescoping type of configuration.

In a preferred embodiment, the upper ends 625 of the frame 640 are rotatably connected to monitor 610, such as, for example by a ball and socket type connection. Additionally, in a preferred embodiment, lower portion 645 is rotatably connected to the back portion 650 of frame 640 at a point designated as reference numeral 655. Therefore, when keyboard 630 is positioned on frame 640, the orientation of the frame (and therefore the orientation of the keyboard) may be adjusted by rotating the frame 640 about either, or both, of the previously described rotatable connections. Thus, the position of the frame 640 and keyboard 630 may be adjusted to the most ergonomically correct position for any given user.

Additionally, a ramp 670 is formed at a lower end of keyboard support frame 640. Ramp 670 assists keyboard 630 in the transition from the desktop to a substantially vertical position within support frame 640. Ramp 670 may be a separate unit or it may be integral with keyboard support frame 640.

Figure 7:
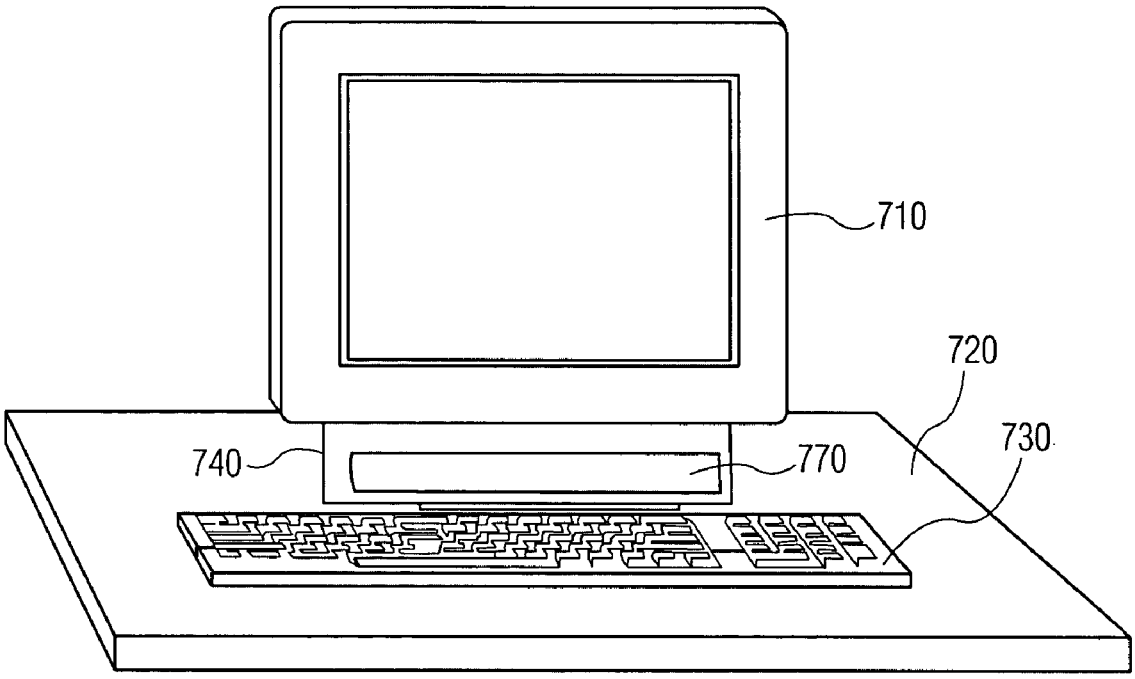
FIG. 7 is a front view illustrating a keyboard and monitor assembly in accordance with an embodiment of the present invention.

FIG. 7 is a front view illustrating a keyboard and monitor assembly in accordance with an embodiment of the present invention. Keyboard 730 is illustrated positioned on desktop 720. Monitor 710 is supported by monitor support member (not shown) which also rests on desktop 720. A ramp 770 is shown spanning substantially the width of monitor 710. As seen more clearly in FIG. 3, the ramp is angled in a manner which assists keyboard 730 in its transition from its position on desktop 720 to a new position within a channel formed between monitor 710 and the support member. Also shown in FIG. 7 is a lower portion of keyboard support frame 740 which is extending outward from a lower portion of monitor 710.

Although the illustrative embodiments of the present invention have been described herein with reference to the accompanying drawings, it is to be understood that the invention is not limited to those precise embodiments, and that various other changes and modifications may be affected therein by one having ordinary skill in the art without departing from the scope or spirit of the invention. All such changes and modifications are intended to be included within the scope of the invention as defined by the appended claims.

What is claimed is:

1. An apparatus for supporting an input device, comprising:

a frame member that includes:

an upper end that is attached to a monitor, and a lower end that extends from a lower portion of the monitor, wherein:

the frame member is configured to allow the input device to be positioned in both a first position and a second position, the first position is an extended position in which the input device is extended approximately outward from a front surface of the monitor, the second position is a retracted position in which the input device is retracted approximately in line with and adjacent to a rear surface of the monitor, and the lower end of the frame member supports the input device in at least the second position.

2. The apparatus as recited in claim 1 wherein the frame member is configured to extend from the rear surface of the monitor, at a point at which the upper end is attached to the monitor, toward the lower portion of the monitor and continuing to extend from the lower portion of the monitor outward and away from the front surface of the monitor to support the input device.

3. The apparatus as recited in claim 1 wherein the frame member is substantially C-shaped.

4. The apparatus as recited in claim 1 wherein the lower end of the frame member is configured to move from an extended position that is down from a lower surface of the monitor to a retracted position that is up towards the lower surface of the monitor.

5. The apparatus as recited in claim 1 further comprising a tray attached to the lower end of the frame member for supporting the input device.

6. The apparatus as recited in claim 1 wherein the frame member is configured to be selectively positioned at an ergonomic angle.

7. The apparatus as recited in claim 1 wherein the upper end of the frame member is rotatably attached to the monitor to facilitate changing an angle of the input device with respect to the user when the input device is in the first position.

8. The apparatus as recited in claim 1 wherein the frame member comprises at least one elongated tubular member.

9. The apparatus as recited in claim 1 wherein the input device is split along a longitudinal axis to allow the input device to fold along the longitudinal axis.

10. The apparatus as recited in claim 1 wherein the lower end of the frame member supports the input device in a location adjacent to the monitor.

11. The apparatus as recited in claim 1 further comprising a ramp attached to the frame member between the upper end and the lower end, wherein the ramp is configured to slidably reposition the input device between the first position and the second position.

12. The apparatus as recited in claim 1 wherein the lower end of the frame member is retractable in a vertical direction to support the input device in a position above a surface of a desktop.

13. A monitor configured to store an input device, the monitor comprising:

a display screen housing having a front surface and a back surface;

a positioning member attached to a portion of the display screen housing for positioning the input device in both a first position and a second position, wherein the first position is an extended position in which the input device is extended approximately outward from the front surface, and wherein the second position is a retracted position in which the input device is retracted approximately in line with and adjacent to the back surface.

14. The monitor as recited in claim 13 further comprising means for removably attaching the input device to the monitor.

15. The monitor of claim 13, wherein the positioning member is rotatably attached to the monitor to facilitate changing an angle of the input device with respect to the user.

16. The monitor of claim 13, wherein the lower end of the positioning member is configured to be removably affixed to the keyboard.

17. A monitor configured to store an input device, the monitor comprising:

a display screen housing having a front surface and a back surface;

a member having an upper end that is attached to the back surface, and a lower end that extends toward the front surface, wherein the member is configured to allow the input device to be positioned in both a first position and a second position, wherein the first position is an extended position in which the input device is extended approximately outward from the front surface, and wherein the second position is a stored position in which the input device is stored approximately in line with and adjacent to the back surface and is supported by the lower end.

18. The monitor of claim 17, comprising the input device.

19. The monitor of claim 17, wherein the member is configured to be selectively positioned at an ergonomic angle.

20. The monitor of claim 17, wherein the upper end of the member is rotatably attached to the monitor to facilitate changing an angle of the input device with respect to the user.

* * * * *